United States Patent [19]

Forquer

[11] Patent Number: 4,519,434

[45] Date of Patent: May 28, 1985

[54] WINDING MECHANISM FOR ROLLABLE SHUTTER CURTAIN

[75] Inventor: William F. Forquer, Venice, Fla.

[73] Assignee: Security Shutter Corporation, Venice, Fla.

[21] Appl. No.: 443,047

[22] Filed: Nov. 19, 1982

[51] Int. Cl.[3] ..... E06B 9/08

[52] U.S. Cl. ..... 160/133; 138/115; 138/162; 242/68.5

[58] Field of Search ..... 160/133; 138/115, 116, 138/117, 162; 242/68.5

[56] References Cited

U.S. PATENT DOCUMENTS

| | | | |
|---|---|---|---|
| 3,425,456 | 2/1969 | Schibig | 138/162 |
| 3,682,434 | 8/1972 | Boenig | 138/162 |
| 3,799,470 | 3/1974 | Gavere et al. | 242/68.5 |
| 3,889,715 | 6/1975 | Lilja et al. | 138/117 |
| 4,176,804 | 12/1979 | Nemoto et al. | 242/68.5 |
| 4,294,302 | 10/1981 | Ricke, Sr. | 160/133 |

FOREIGN PATENT DOCUMENTS

| | | | |
|---|---|---|---|
| 1921001 | 11/1970 | Fed. Rep. of Germany | 160/133 |
| 1231746 | 10/1960 | France | 160/133 |
| 1272122 | 8/1961 | France | 160/133 |

*Primary Examiner*—Peter M. Caun

*Attorney, Agent, or Firm*—Hauke and Patalidis

[57] ABSTRACT

A winding mechanism for rolling and unrolling an articulated shutter curtain, the winding mechanism comprising a tubular drum with a plurality of integral, spaced-apart arms protruding from its exterior surface. The shutter curtain is attached to one of the arms such that rotation of the tubular drum rolls up the curtain from an extended position or rolls down the curtain from a rolled-up position. More particularly, each arm is alternatively provided at one end with either a rod-like or socket-like projection extending along an edge thereof for slidable interconnection with the rod-like or socket-like projection extending along an edge of the top slat of the shutter curtain. In addition, each arm portion is provided with an arcuate land portion for supporting the shutter in a rolled-up fashion. The tubular drum from which the arms protrude is formed with two half cylindrical elongated members which are slidably engaged by longitudinal bent-over interlocking portions disposed along each edge of the members. In addition, the tubular drum is preferably provided with at least one circular disk affixed at an end thereof for acting as a lateral guide when the shutter curtain is rolled up by the winding mechanism. The winding mechanism is suitable for use with a shutter system operated by an electric motor as well as for a shutter system operated by manual drive means.

14 Claims, 9 Drawing Figures

FIG. 6
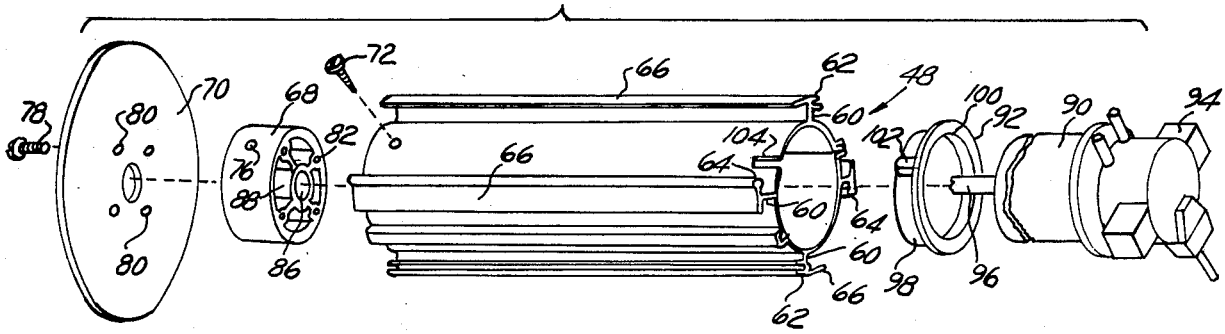
FIG. 7
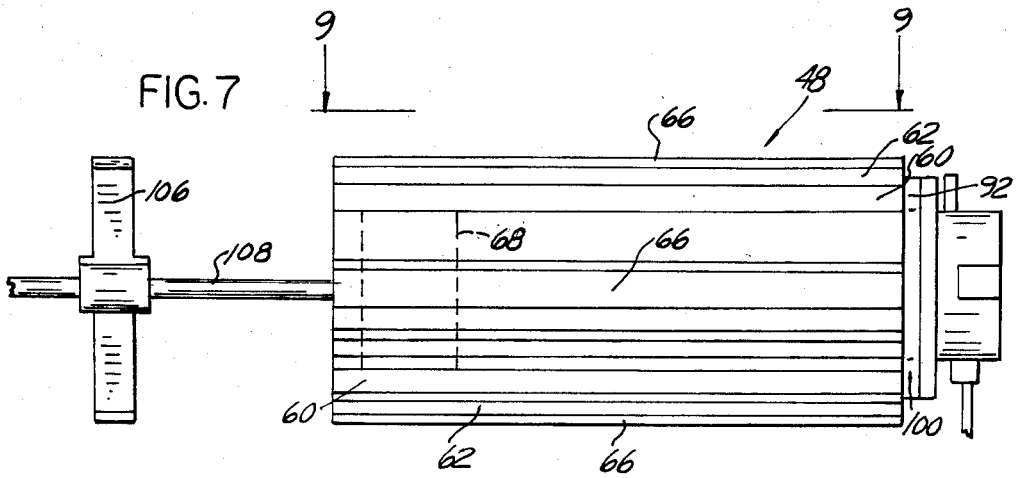
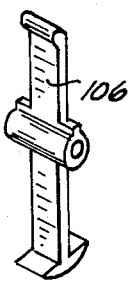
FIG. 8
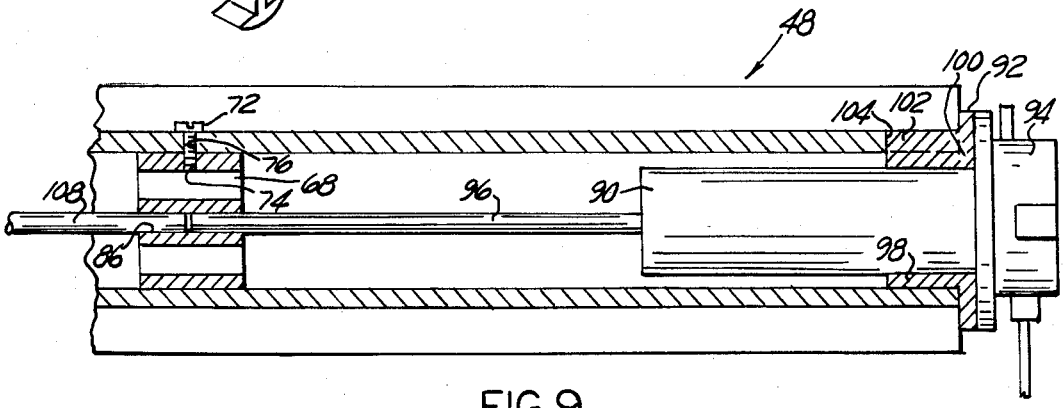
FIG. 9

WINDING MECHANISM FOR ROLLABLE SHUTTER CURTAIN

BACKGROUND OF THE INVENTION

The present invention relates to an articulated curtain in the form of interlocking slat members which are assembled such as to form a shutter or awning, or a combined shutter/awning, for protecting an opening in a wall. More particularly, the present invention relates to a protective roll-type shutter or awning formed of a plurality of interlocking pivoting slat members.

It is known to design a roll-type shutter or awning in the form of an articulated curtain which can be rolled away by winding the interlocking slats comprising the curtain around a drum or rotatable shaft. When desired, such a curtain of pivotable slats can be extended by unrolling the curtain from the drum or rotatable shaft so as to provide protection against damage to a window or door caused by rain, snow, high wind or vandalism. Examples of such devices are disclosed in U.S. Pat. No. 4,294,302 and co-pending application Ser. No. 337,664, now abandoned for Shutter and Awning Material, both assigned to the same assignee as the present invention.

More particularly, the aforesaid U.S. patent discloses a shutter and awning device wherein a driven shaft retracts an articulated shutter curtain. The driven shaft is provided with a series of splines formed about its periphery. A collar having a bore of complementary shape to that of the splines on the driven shaft is assembled over the shaft on either end thereof. Formed with the collar is a driving lug having a lower portion and an upper portion. The upper portion of the driving lug is adapted to be received by a rod-like projection extending along an edge of the uppermost slat of a shutter curtain. Therefore, when the driven shaft is rotated the first slat is moved about the axis of the driven shaft and, due to a force transmitting relationship between the uppermost slat and the other slats of the shutter curtain, the uppermost slat pulls up the other slats and rolls the shutter curtain around the driven shaft.

There are disadvantages to the above-described means for winding up, or down, a rollable, articulated shutter curtain of pivotable interlocked slats. In general, these disadvantages are also present in the other known prior art winding mechanisms. One of these disadvantages is that the prior art means provided for attaching the top slat of the shutter curtain to the rotatable drum or shaft may require that a particular edge of the slat, which is compatible with the attaching means of the drum or rotatable shaft, be positioned adjacent to the attaching means of the winding mechanism which complicates the process of assemblying the shutter curtain and attaching the curtain to the winding mechanism.

Furthermore, it has been discovered that a shutter curtain wound around a driven shaft tends to bind upon winding and is not wound in a uniform shape around the lug.

Another difficulty with known mechanisms for winding up or rolling down articulated shutter curtains is that they are either not suitable for use with an electric motor, or, after the winding mechanism of a shutter-/awning assembly has been installed, the electric motor is not readily accessible for repair.

What is needed, therefore, is an improved winding mechanism for a rollable shutter curtain which remedies the inconveniences, which is simple in design and which is relatively inexpensive to manufacture.

SUMMARY OF THE INVENTION

It is, therefore, the principal object of the present invention to provide a novel winding mechanism for an articulated shutter curtain of a rollable shutter/awning assembly. The improved winding mechanism is suitable for use with a wide variety of pivotable, interocking slats which are presently available without regard to which edge of a particular top slat is adjacent to the means for attaching the shutter curtain to the winding mechanism.

In addition, the improved winding mechanism, being in the form of a spoke or arm provided tubular drum, facilitates winding of a shutter curtain, without binding, into a uniform roll around the tubular drum.

A further novel feature of the winding mechanism is particularly advantageous where the winding mechanism is driven in rotation by an electric motor. Slidable disengagement of a portion of the tubular drum permits access to the electric motor mounted therein without any need to detach the winding mechanism from the frame of the shutter awning assembly, or from an adjacent wall to which it is mounted, for example.

These and other objects of the present invention will become apparent to those skilled in the art when the following description of the best modes contemplated for practicing the invention is read in conjunction with the accompanying drawing wherein like numerals refer to like or equivalent parts and in which:

BRIEF DESCRIPTION OF THE DRAWING

FIG. 6 is a view similar to FIG. 5 but showing a modification of a winding mechanism according to the present invention in use with an electric motor;

FIG. 7 is a front elevation view of a further modification of a winding mechanism according to the present invention;

FIG. 8 is a perspective view of a part thereof; and

FIG. 9 is a partial sectional view of the example of winding mechanism of FIG. 7 from lines 9—9 thereof.

DETAILED DESCRIPTION OF THE PREFERRED EMBODIMENTS

Figure 1:
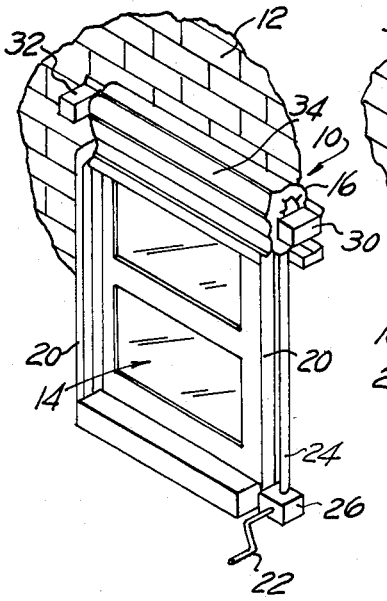
FIG. 1 is a schematic illustration of, for example, a window provided with a rollable shutter and/or awning device comprising interlocked slats schematically illustrated in retracted position.
Figure 2:
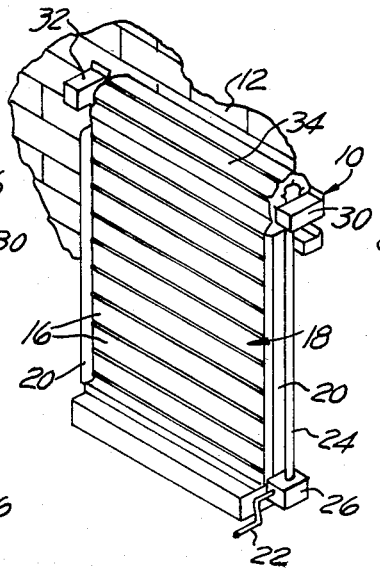
FIG. 2 is a view similar to FIG. 1 but showing a shutter curtain extended over the window.
Figure 3:
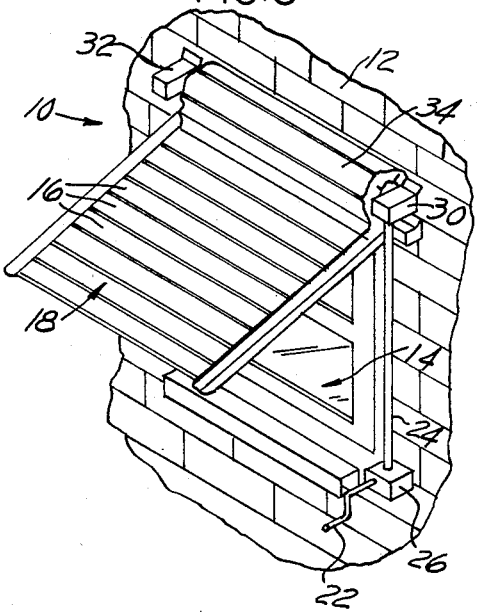
FIG. 3 is a view similar to FIG. 2 but showing the shutter curtain in an awning position.

Referring to FIGS. 1–3, there is illustrated in a schematic manner and in perspective view a combination shutter and awning system 10 for protecting an opening in the wall 12 of a building, the opening, in the example of structure illustrated, being a window 14. The shutter and awning system 10, as described in detail in U.S. Pat. No. 4,294,302 comprises a plurality of relatively narrow slats 16 disposed horizontally with their longitudinal edges mutually pivotably interlocked such as to form a shutter curtain 18 when extended over and therefore masking the window 14, as shown at FIG. 2. The ends of the slats 16 are adapted to engage into and be slidably held by a pair of parallel vertically disposed side rails 20, each generally in the form of a U-shaped channel. As shown at FIGS. 1–3, the curtain 18 of slats 16 is raised and lowered by one example of a winding mechanism according to the present invention comprising a hand crank 22 driving a shaft 24 through a gear box 26, the shaft 24 driving through a second gear box 30 fastened to the wall 12 a shaft, not shown, supported at its other end by a bracket 32. The shaft driven through the gear box 30 rotates a tubular drum with one or more spoke-like members or arms, FIG. 4, as more fully described hereafter. When the drive shaft is rotated, the curtain 18 of slats 16 winds itself around the tubular drum or the spoke-like members of the drive shaft in the form of a roll 34, raising the curtain 18 of slats 16 and uncovering the window 14.

To form an awning, FIG. 3, the side rails 20 are made pivotable at their top end such as to be capable of being swung out to the position shown, a pair of arms, not shown, each attached at an end to the bottom of a side rail 20, holding the side rails in the illustrated pivoted position. Locking means disposed, for example, in the gear box 26 permits to immobilize the curtain 18 of slat members 16 either in its raised position, FIG. 1, or in its fully lowered shutter position, FIG. 2, or awning position, FIG. 3, or in any intermediary position.

Figure 4:
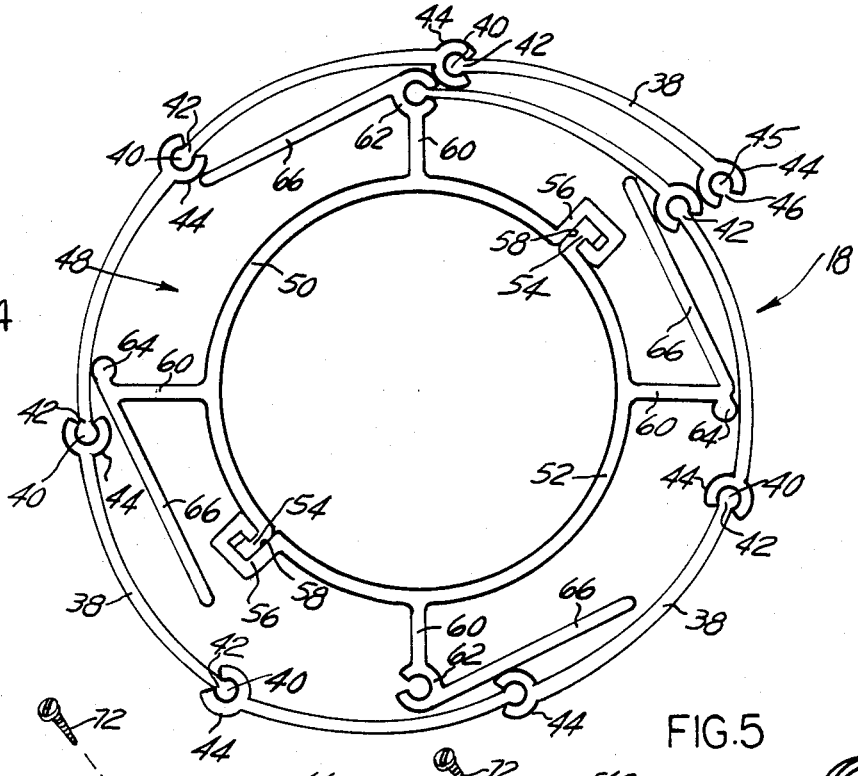
FIG. 4 is a side elevation view of an example of a tubular drum of a winding mechanism of the present invention with a series of interlocked slats connected to one arm of the drum.

In the example of structure illustrated by the drawings and more particularly with reference to FIG. 4, the articulated curtain 18 is comprised of a plurality of curved slat members 38 cut to a predetermined uniform length. One edge of each slat member 38 is hingedly or pivotably connected to an adjoining slat member 38 by mating locking and interlocking means extending longitudinally along the respective edges of each slat member 38, as disclosed in the aforesaid U.S. Letters Patent.

As shown at FIG. 4, the locking means extending along one edge of each slat member 38 consists of an integral rod-like projection or bead 40. Each bead 40 is cylindrical around the majority of its periphery except for a bridging portion 42 where formed integrally with the body of a slat member 38. The interlocking means extending along each edge of each slat member consists of a longitudinal groove or socket 44. Each socket 44 has a longitudinal cylindrical bore 45 and a longitudinal slot-like opening 46 protruding from the bore 45 to the edge of the slat member 38.

In the structure of FIG. 4, each slat member 38 is hingedly connected along the respective edges of the adjoining slat members 38 by slidably engaging the cylindrical portions of the beads 40 protruding from the slat members 38 into the longitudinal bores 45 of the socket 44 provided along the edges of the adjoining slat members 38 such as to form the articulated curtain 18.

The pivotability of the slat members 38 hingedly interconnected together permits the articulated curtain 18 to be wound around a tubular drum as hereafter described when the shutter or awning device 10 is rolled up.

Although the winding mechanism of the present invention is illustrated in use with pivotably interconnected slat members of the socket-bead type, it will be readily apparent that the winding mechanism is easily adaptable for use with other types of pivotable slats, such as the type disclosed, for example, in co-pending application for Interconnected Slat Members, Ser. No. 365,511, assigned to the same assignee as the present application.

Figure 5:
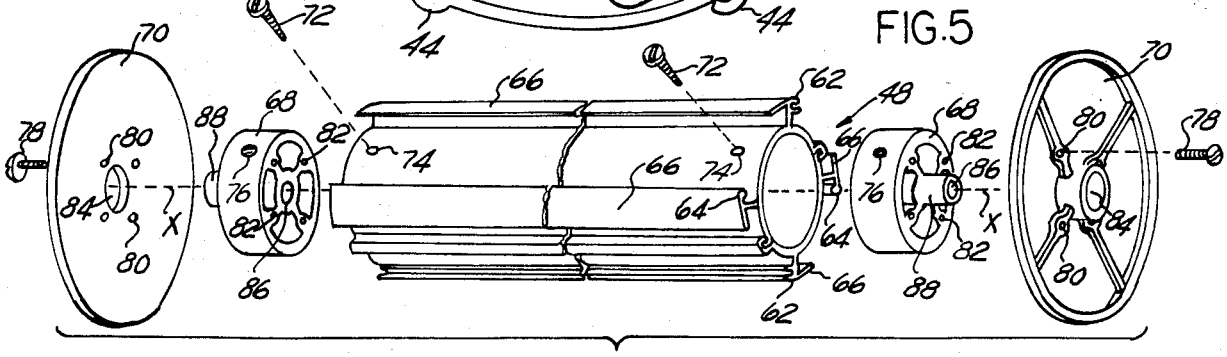
FIG. 5 is an exploded schematic perspective view of one example of a winding mechanism according to the present invention.

At FIGS. 4–6, a tubular drum 48, being circularly cylindrical as shown, is formed of two substantially half cylindrical elongated arcuate members 50,52. The arcuate members 50,52 forming the tubular drum 48 are slidably interengageable along bent-over, integral interlocking seam portions 54,56. The seam portions 54,56 protrude substantially at right angle along the longitudinal edges of the respective arcuate members 50,52. Each arcuate member 50,52 is provided along one longitudinal edge with an interlocking seam portion 54 which is L-shaped in cross-section and along its other longitudinal edge with an interlocking seam portion 56 which is rectangular in cross-section except for a transverse slot 58 permitting introduction of the L-shaped interlocking seam portion 54 of the other arcuate member.

With such a combination of an L-shaped interlocking seam portion 54 along one longitudinal edge and a substantially rectangular interocking seam portion 58 along the other longitudinal edge, the respective arcuate members 50,52 forming the tubular drum 48 are symmetrical to each other. However, it is readily apparent that the tubular drum 48 could be formed of more than two arcuate members 50,52 with each arcuate member slidably interengageable with the next and each arcuate member comprising an arc of an equally proportionate amount of 360°. It is also readily apparent that other means for slidably engaging the respective arcuate members 50,52 are suitable. For example, each arcuate member could be provided along one longitudinal edge with a bead and along the other longitudinal edge with a socket in the same manner that the aforementioned slat members 38 are connected to each other. Another possible means of slidably interconnecting the arcuate members 50,52 forming the tubular drum 48 would be to provide each longitudinal edge of the respective arcuate members 50,52 with bent-over interengaging U-shaped or J-shaped hook portions.

The tubular drum 48 is further provided around its exterior surface with a plurality of spoke-like arm members 60 integrally protruding at right angle from the exterior surface of the tubular drum 48 and disposed longitudinally across the exterior surface. As shown, the arm members 60 are equally spaced apart from each other and are four in number. However, only one arm member 60 is absolutely necessary.

In the illustrated structure, two of the arm members 60 diametrically opposed from each other are provided at one end with a socket 62 with the same configuration as the socket 44 of the slat members 38. The other two arm members 60, also being diametrically opposed from one another, are provided with beads 64 similar to the beads 40 of the slat members 38. This permits the top slat member 38 of the shutter curtain 18 to be slidably engaged with any one of the four arm members 60, without regard to whether the socket-provided edge or the bead-provided edge of the slat member 38 is adjacent to the tubular drum 48 at the time of installation. If the uppermost slat member 38 is provided along its top longitudinal edge with a socket 44 then the shutter curtain will be slidably connected to an arm member 60 which is provided at its end with a bead 64. On the other hand, if the uppermost slat member 38 of the shutter curtain 18 is provided along its top longitudinal edge with a bead 40, then the shutter curtain 18 will be slidably connected to an arm member 60 which is provided with a socket 62.

Each arm member 60 is also provided with a land portion 66 protruding rearwardly from either the socket 62 or the bead 64 of the arm member 60. This land portion 66 facilitates rolling the shutter curtain 18 into a uniform roll and provides support for the slat members 38 when the shutter curtain 18 is in a rolled-up position. As shown in the drawings, the land portion 66 of the arm members 60 is substantially flat, however, it may be desirable to form such a land portion 66 in an arcuate shape conforming to the arcuate shape of the respective slat members 38.

It is readily apparent, therefore, that rotation of the tubular drum 48, by manual gear drive means as shown in FIGS. 1–3, or by electric motor drive means, as more fully explained hereafter, causes the top slat member 38 whose bead 40 or socket 44 is slidably engaged within a bead 64 or socket 62 of an arm member 60 to be raised or lowered depending on the rotation of the tubular drum 48. Because the other slat members 38 are each hingedly and pivotably interconnected with the first slat member 38, rotation of the tubular drum 48 by manual drive or electric drive means rolls up or down the shutter curtain 18, as desired.

The arcuate members 50,52 forming the tubular drum 48 and the arm members 60 projecting from the respective arcuate members 50,52 are preferably molded or extruded of one piece. It has been found that plastic and aluminum are particularly suitable materials from which to manufacture the respective elements of the invention; however, other materials such as wood or other metals can be used.

Although the tubular drum 48 of the winding mechanism is illustrated for use with the shutter curtain 18 of a shutter/awning assembly, such a tubular drum 48 has application to other areas. For example, a screen for image projection could easily be wound around such a tubular drum 48 by fastening the top end of the screen to the land portion 66 of an arm member 60, for example, by screws.

Moreover, if it is desired to use the tubular drum 48 of the winding mechanism with slats other than those of the bead-socket type, the arm members 60 protruding from the tubular drum 48 need only be provided with whatever type of end portion which would be compatible with such slats.

FIGS. 5–9 illustrate various winding mechanisms according to the present invention which incorporate the above described tubular drum 48. At FIG. 5 is shown, in an exploded view, a winding mechanism, with gear drive and shaft omitted, particularly suitable for use where the winding mechanism is manually operated. As shown, the winding mechanism comprises a tubular drum 48, a pair of annular hubs 68 each mounted in the tubular drum 48 proximate a respective end of the tubular drum 48 and a pair of annular disks 70 each affixed at an end of the tubular drum 48. The hubs 68 may be retained proximate the ends of the tubular drum 48, for example, by passing a screw 72 through aligned transverse bores 74,76 in the peripheries of the tubular drum 48 and the hubs 68, FIG. 9. The annular disks 70 can be affixed to the respective ends of the tubular drum 48 by passing a plurality of bolts 78 through aligned bores 80,82 in the disks 70 and in the mounted hubs 68.

The annular disks 70, numbering two as shown at FIG. 5, act as lateral guides for the shutter curtain 18 when it is rolled around the tubular drum 48. The annular disk 70 has a bore 84 accepting therethrough a reduced diameter portion, or boss, 88 on one side of the hub 68. The hub 68 has an axial bore 86 which is provided with interior ridges, not shown, accepting for coupling thereto a splined driven shaft of longitudinal axis as indicated at "X" at FIG. 5, such that rotation of the driven shaft rotates the hubs 68, the tubular drum 48, and the disks 70, such that the shutter curtain, not shown, is raised or lowered by manual or electrical rotation of the driven shaft, as desired.

At FIG. 6, a further winding mechanism incorporating a tubular drum 48, as heretofore described, is shown in an exploded view. In the embodiment of FIG. 6, only one annular disk 70 and one hub 68 are employed, the hub 68 and the annular disk 70 being mounted at one end of the tubular drum 48 in the same manner as previously described. The other end of the tubular drum 48 is supported by the cylindrical end casing 90 of a reversible electric motor 94 through a bearing collar 92. The motor end casing 90 forms an enclosure for appropriate gearings driving an output shaft 96 from the electric motor 94, which is preferably provided with a one-way clutch so that, in the event of electrical failure, the tubular drum 48 can be manually driven from its other end.

The electric motor 94 is supported from the building wall by an appropriate bracket, not shown, and the end of the motor output shaft 96 is disposed through the hub axial bore 86, FIGS. 6 and 9, and is coupled to the hub 68 by any appropriate means such as set screws, key and keyway means and the like, not shown. The bearing collar 92 has a flange portion 100 which, if so desired, may have a diameter substantially equal to that of the disk 70 for acting as a lateral guide for the rolled up shutter curtain. A lug 102 extends across the exterior periphery of the body portion 98 of the bearing collar 92 and is formed such as to engage a corresponding slot 104 through the peripheral wall of the tubular drum 48 proximate one end of the tubular drum 48, such that the bearing collar 92 journals around the motor end casing 90.

In the embodiment of FIG. 6, the tubular drum 48 extends the entire distance corresponding to the width of the shutter curtain to be wound into a roll. However, at FIG. 7, an embodiment is shown wherein the tubular drum is provided with only a portion of the width of the articulated curtain to be wound thereon. The portion of the articulated curtain to be wound in a roll which is not formed around the tubular drum 48 is wound around a spider member 106, FIG. 8, mounted on a support shaft 108 engaged at an end in the bore 86 of the hub 68 mounted in the tubular drum 48.

Referring now to FIG. 9, the coupling between the electric motor 94 and the tubular drum 48 is shown in greater detail. More particularly, it can be seen that the output shaft 96 of the electric motor drive projects from the motor end casing 90 and into the bore 86 of the hub 68. The support shaft 108 has its end also engaged in the bore 86 of the hub 68. If it is desired to gain access to the differential or gearing in the end casing 90 of the electric motor drive, one of the arcuate members 50 forming each half of the tubular drum 48 may be longitudinally displaced, thereby exposing the motor end casing 90. Of course, prior to disengaging one of the arcuate members 50 forming the tubular drum 48, it is necessary to remove the articulated curtain. No further disassembly is required. If the whole motor drive assembly requires replacement, this can be done without removing the entire drum 48 simply by slipping off one of the arcuate members 50, supporting the other, and removing and replacing the motor drive assembly.

Having thus described the invention by way of examples of structure well designed for practicing the invention, modification whereof will be apparent to those skilled in the art,

What is claimed as new is as follows:

1. A winding mechanism for rolling and unrolling a curtain, said winding mechanism comprising at least a pair of elongated arcuate members slidably interengageable such as to form a tubular drum, at least one arm portion integrally protruding from and longitudinally disposed across the exterior surface of said tubular drum, connecting means for attaching an end of said curtain to an end of one of said arm portions and driving means for rotating said tubular drum and said integrally protruding arm portions about the longitudinal axis of said tubular drum.

2. The winding mechanism of claim 1 wherein each of said arcuate members is symmetrical.

3. The winding mechanism of claim 1 wherein each of said arcuate members is substantially half cylindrical.

4. The winding mechanism of claim 1 wherein said arcuate members are slidably interengageable by bent-over integral interlocking portions protruding substantially at right angle from the longitudinal edges of said arcuate members.

5. The winding mechanism of claim 4 wherein at least one of said bent-over, integral, interlocking portions is L-shaped in cross-section.

6. The winding mechanism of claim 4 wherein at least one of said bent-over, integral, interlocking portions is rectangular in cross-section and has a slot permitting introduction of the other of said interlocking portion.

7. The winding mechanism of claim 1 wherein each of said arm portions is provided with a protruding, elongated land portion for supporting said curtain when said curtain is wound into a roll.

8. The winding mechanism of claim 1 wherein said connecting means for attaching an end of said curtain to an end of one of said arm portions further comprises an integral rod-like projection extending along a lateral edge of said end of said curtain, a protruding socket portion extending along a lateral edge of said one of said arm portions and wherein said rod-like projection and said protruding socket portion are attached together by sliding said rod-like projection into said projecting socket portion.

9. The winding mechanism of claim 1 wherein said driving means for rotating said tubular drum comprises an electric motor and means for attaching said tubular drum to a driven shaft of said electric motor.

10. The winding mechansim of claim 1 wherein said driving means for rotating said tubular drum comprises a rotatable driving shaft, a rotatable driven shaft, means for coupling said rotatable driving shaft to said rotatable driven shaft, means for rotating said rotatable driving shaft and means for coupling said rotatable driven shaft to said tubular drum.

11. The winding mechanism of claim 1 further provided with at least one hub affixed within said tubular drum for coupling a driving shaft to said tubular drum.

12. The winding mechanism of claim 10 further provided with at least one hub affixed within said tubular drum for coupling a driving shaft to said tubular drum.

13. The winding mechanism of claim 11 further provided with at least one hub affixed within said tubular drum for coupling a driving shaft to said tubular drum.

14. The winding mechanism of claim 1 further comprising at least one circular disk affixed at an end of said tubular drum.

* * * * *